US007059151B2

(12) United States Patent
Taras et al.

(10) Patent No.: US 7,059,151 B2
(45) Date of Patent: Jun. 13, 2006

(54) REFRIGERANT SYSTEMS WITH REHEAT AND ECONOMIZER

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 63 days.

(21) Appl. No.: 10/892,035

(22) Filed: Jul. 15, 2004

(65) Prior Publication Data

US 2006/0010908 A1 Jan. 19, 2006

(51) Int. Cl.
*F25B 41/00* (2006.01)

(52) U.S. Cl. ..... 62/513; 62/90

(58) Field of Classification Search ..... 62/513, 62/238.6, 176.1, 196.4, 90
See application file for complete search history.

(56) References Cited

U.S. PATENT DOCUMENTS

| | | | | |
|---|---|---|---|---|
| 3,264,840 | A * | 8/1966 | Harnish | 62/173 |
| 5,651,258 | A * | 7/1997 | Harris | 62/90 |
| 6,381,970 | B1 * | 5/2002 | Eber et al. | 62/90 |
| 6,427,461 | B1 * | 8/2002 | Whinery et al. | 62/176.6 |
| 6,701,723 | B1 | 3/2004 | Dobmeier et al. | |
| 6,941,770 | B1 * | 9/2005 | Taras et al. | 52/512 |

* cited by examiner

*Primary Examiner*—Melvin Jones
(74) *Attorney, Agent, or Firm*—Carlson, Gaskey & Olds

(57) ABSTRACT

Refrigerant system schematics are provided with enhanced humidity and temperature control of the air supplied to an environment to be conditioned. In particular, an economizer cycle is incorporated to be utilized in a combination with a reheat coil. Proposed system configurations enhance system performance characteristics, offer more steps of unloading, especially in the reheat mode of operation, and operate at improved reliability. Additionally, due to the enhanced performance of the economizer cycle, the reheat coil size can be reduced.

21 Claims, 6 Drawing Sheets

REFRIGERANT SYSTEMS WITH REHEAT AND ECONOMIZER

BACKGROUND OF THE INVENTION

This application relates to refrigerant systems that incorporate both an economizer cycle and a reheat coil in several unique configurations to provide better dehumidification performance and temperature control.

Refrigerant cycles are utilized to control the temperature and humidity of air in various environments. In a typical refrigerant cycle, a refrigerant is compressed in a compressor and delivered to a condenser. In the condenser, heat is exchanged between outside ambient air and the refrigerant. From the condenser, the refrigerant passes to an expansion device at which the refrigerant is expanded to a lower pressure and temperature, and then to an evaporator. In the evaporator heat is exchanged between the refrigerant and the indoor air, to condition the indoor air. When the refrigerant cycle is operating, the evaporator cools the air that is being supplied to the indoor environment. In addition, as the temperature of the indoor air is lowered, moisture usually is also taken out of the air. In this manner, the humidity level of the indoor air can also be controlled.

In some cases, the temperature level, to which the air is brought to provide a comfort environment in a conditioned space, may need to be higher than the temperature that would provide the ideal humidity level. This has presented design challenges to refrigerant cycle designers. One way to address such challenges is to utilize various schematics incorporating reheat coils. In many cases, the reheat coils, placed on the way of indoor air stream behind the evaporator, are employed for the purpose of reheating the air supplied to the conditioned space after it has been overcooled in the evaporator, where the moisture has been removed.

One of the options available to a refrigerant system designer to increase efficiency is a so-called economizer cycle. In the economizer cycle, a portion of the refrigerant flowing from the condenser is tapped and passed through an economizer expansion device and then to an economizer heat exchanger. This tapped refrigerant subcools a main refrigerant flow that also passes through the economizer heat exchanger. The tapped refrigerant leaves the economizer heat exchanger, usually in a vapor state, and is injected back into the compressor at an intermediate compression point. The subcooled main refrigerant is additionally subcooled after passing through the economizer heat exchanger. The main refrigerant then passes through a main expansion device and an evaporator. This main flow will have a higher cooling capacity because it was additionally subcooled in the economizer heat exchanger. An economizer cycle thus provides enhanced system performance. In an alternate arrangement, a portion of the refrigerant is tapped and passed through the economizer expansion device after being passed through the economizer heat exchanger (along with the main flow). In all other aspect this arrangement is identical to the configuration described above.

As mentioned above, another option available to a refrigerant system designer is to include a reheat coil into the system schematics. As known, at least a portion of the refrigerant upstream of the expansion device is passed through a reheat heat exchanger and then is returned back to the main circuit. At least a portion of a conditioned air having passed over the evaporator is then passed over this reheat heat exchanger to be reheated to a desired temperature.

Recently, the assignee of this application has developed a system that combines the reheat coil and economizer cycle. However, variations of this basic concept have yet to be fully developed.

SUMMARY OF THE INVENTION

In a broad statement of this invention, a refrigerant system incorporates both an economizer cycle and a reheat cycle, or in other words, has an ability to operate in the economized mode and in at least in one of the reheat modes, in addition to a conventional cooling mode. The two (economizer and reheat) branches of the system are each connected in such a way to the main system circuit that they can be optionally utilized either simultaneously or exclusively upon the refrigeration system designer decision. Essentially, the benefit of utilizing the two concepts in a single refrigerant system is that the economizer cycle allows the refrigerant to be brought to a lower temperature in the evaporator due to extra subcooling obtained in the economizer heat exchanger, with simultaneous enhancement of the overall system performance (capacity and/or efficiency). This will allow more moisture to be removed from the indoor air passing over the evaporator enhancing system performance. In the proposed system cycle schematics, air can be passed over the reheat coil such that its temperature can be brought back up to a desired level, without the air regaining moisture content. Thus, if a desired humidity level would correspond to an air temperature that is below the desired comfort level, the combination of an economizer cycle and a reheat coil will allow the refrigerant cycle to achieve the desired humidity level, while providing the desired temperature level and improving an overall system performance.

Additionally, a higher number of unloading steps is offered so that the system can more precisely match sensible and latent load requirements. This, in turn, will reduce a number of start-stop cycles and improve system reliability and stability of an indoor environment in terms of temperature and humidity.

In general, several cycle schematics provide additional control to a combined reheat and economizer system. Details of these cycle schematics for performing the above are disclosed in more detail in the following specification and drawings, the following of which is a brief description.

DETAILED DESCRIPTION OF THE PREFERRED EMBODIMENT

Figure 1A:
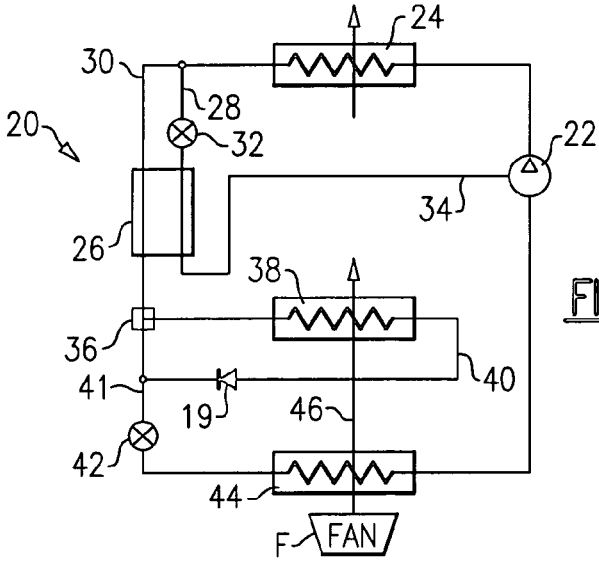
FIG. 1A shows a first schematic.

FIG. 1A shows a refrigerant system 20 incorporating a compressor 22 for compressing a refrigerant and passing the refrigerant downstream to a condenser 24. An economizer cycle is incorporated in the refrigerant system 20 downstream of the condenser 24. In the economizer cycle, an economizer heat exchanger 26 receives a tapped refrigerant flow 28, and a main refrigerant flow 30. As can be seen, the tapped refrigerant flow in this embodiment is tapped from the main refrigerant flow 30 downstream of condenser 24. The tapped refrigerant passes through an economizer expansion device 32. After having passed through the economizer expansion device 32, the tapped refrigerant is at a lower pressure and temperature, and is able to cool the main flow refrigerant 30 in the economizer heat exchanger 26. In a preferred embodiment, the flow of the tapped refrigerant through the economizer heat exchanger 26 is actually in the reverse direction to that illustrated (that is in the opposed direction to the flow 30). However, the flows are illustrated in the same direction to simplify the drawing.

The tapped refrigerant is typically returned as a vapor to be injected into the compressor 22 through the line 34.

Downstream of the economizer heat exchanger 26, a three-way valve 36 selectively communicates at least a portion of the refrigerant to a reheat coil 38. The refrigerant passes to a line 40 downstream of the reheat coil 38 through check valve 19, and rejoins the main refrigerant flow at point 41. Downstream of point 41 is a main expansion device 42, and an evaporator 44. Thus, the main refrigerant then flows from the main expansion device 42 to the evaporator 44, and is returned to a suction port of the compressor 22.

As is known, an indoor airflow 46 is cooled in the evaporator 44. As the air is cooled, the moisture content in the air stream is typically reduced, and, thus, the air supplied to the conditioned space has been dehumidified. As also known, if the temperature of air leaving the evaporator is lower than desired for the conditioned space, a reheat coil 38 can be placed behind the evaporator 44 to reheat the air stream 46 to a required temperature level. It is likely that achieving the desired levels of temperature and humidity as well as performance characteristics in terms of capacity and efficiency would not be possible in the prior art refrigerant systems. Also, the prior art systems normally would not be able to precisely match the preset values of temperature and humidity in the conditioned space due to their limited capability in terms of unloading steps, causing undesirable variations in these parameters. The present invention improves upon this by combining the economizer heat exchanger 26 with the reheat coil 38.

The economizer cycle may or may not be engaged. To turn off the economizer cycle, the economizer expansion device 32 may be closed down such that no refrigerant is tapped. Similarly, to turn off the reheat coil, the three-way valve 36 may be moved to such a position that no refrigerant is tapped through the reheat coil 38. Thus, either of these two cycles may be utilized independent of the other, or neither could be used. The present invention is mainly directed to providing the ability to use both techniques in combination with each other, while providing a better control over the humidity and temperature. Also, it has to be understood that the three-way valve 36 can be substituted by a pair of conventional valves and if the expansion device is of such a type that it cannot be closed down completely, an additional shutoff valve may be placed on the tap line 28.

When relatively low humidity and temperature levels are desired in the air stream 46, along with the capability to provide a significant amount of sensible and latent capacity, both economizer expansion device 32 and the three-way valve 36 are moved to an open position to operate both the economizer heat exchanger 26 and the reheat coil 38. Refrigerant passing through the main line 30 will be subcooled by the refrigerant from the tap 28. Thus, that refrigerant will have a higher cooling capacity (both sensible and latent) when reaching the evaporator 44. Consequently an air stream 46 can be brought at a lower temperature, to the environment to be conditioned by the refrigerant cycle 20. At this lower temperature, more moisture can be removed from the air. Then, refrigerant passes through the reheat coil 38, where its temperature is reduced further during the heat transfer interaction with the indoor air stream 46 leaving the evaporator 44. As a result, the refrigerant cooling capacity is boosted even further, allowing for even more dehumidification in the evaporator 44. This greatly enhanced overall dehumidification capacity is obtained from passing the refrigerant flow through the economizer heat exchanger 26 and reheat coil 38 in sequence. This drier air then passes over the reheat coil 38, which will have a somewhat hotter refrigerant, as it is positioned upstream of the main expansion device 42. An air moving device F, shown schematically, drives air over the evaporator 44 and reheat coil 38. This somewhat hotter refrigerant will reheat the air 46 to the desired temperature. Moisture has already been removed from this air. Thus, by utilizing the combination of the economizer cycle and the reheat coil, a refrigerant system designer is able to achieve both desired temperature and humidity levels, especially in hot and humid environments. Moreover, the higher efficiency levels are achieved due to implementation of the economizer cycle concept.

Additionally, this invention offers extra steps of unloading, particularly in the reheat mode of operation. Turning a tapped refrigerant flow in the economizer heat exchanger 26 on and off, the system capacity can be correspondingly increased or decreased, depending on the external load requirements. This will allow matching the desired temperature and humidity levels with a greater precision as well as improve system reliability through the reduction of the start-stop cycles. Obviously, an economizer flow can be regulated in a continuous manner either by modulation or pulsation techniques, offering an infinite number of unloading steps. Also, the identical strategy can be executed for the multi-circuit systems, offering even higher flexibility for such configurations.

Figure 1B:
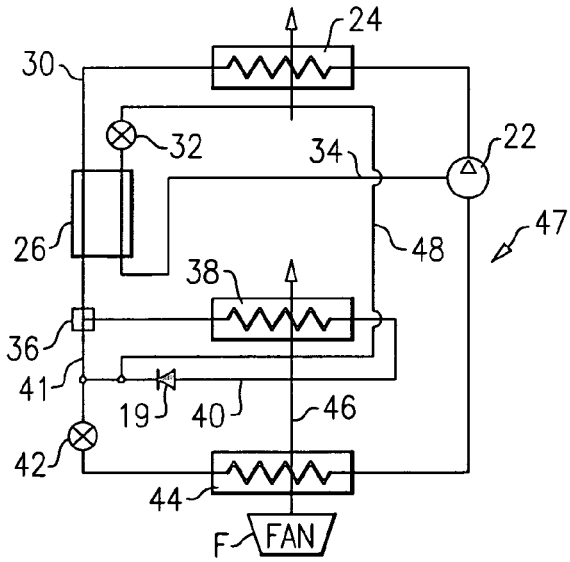
FIG. 1B shows a second schematic and FIG. 1C shows a third schematic.

FIG. 1B shows an alternative cycle configuration wherein the economizer cycle tap 48 is not placed directly downstream of the condenser 24 but rather is located downstream of the reheat coil 38. This cycle 47 is otherwise similar to the FIG. 1A cycle. Also, it is well understood to a person ordinarily skilled in the art that the tap location can be on line 40 (as shown in FIG. 1B) or anywhere on line 41 downstream of the three-way valve 36 and upstream of the main expansion device 42.

Figure 1C:
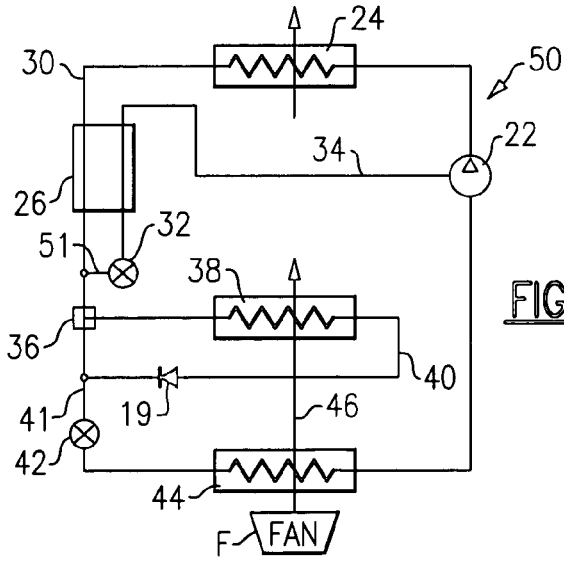

FIG. 1C shows yet an alternative cycle configuration 50 wherein the economizer cycle tap 51 is not placed directly downstream of the condenser 24 but rather is located downstream of the economizer heat exchanger 26 but upstream of the three-way valve 36. This cycle 50 is otherwise similar to the FIG. 1A cycle.

Figure 2A:
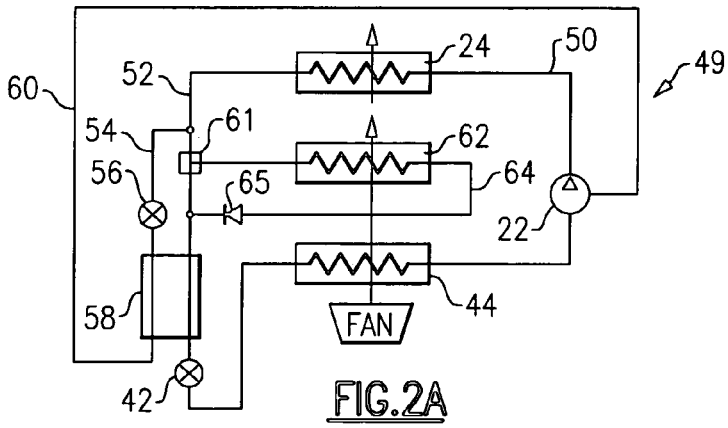
FIG. 2A shows a fourth schematic.

FIG. 2A shows an alternative refrigerant cycle 49 wherein the reheat coil 62 is positioned upstream of the economizer heat exchanger 58. Refrigerant from the compressor 22 passes through the discharge line 50 and then through the condenser 24 and main liquid line 52. A tapped refrigerant portion passes through the tap line 54 from the main liquid line 52 and then passes through an economizer expansion device 56, and to the economizer heat exchanger 58. This tapped flow is typically returned as a vapor through line 60 to the economizer port of compressor 22. In a reheat mode of operation, a three-way valve 61 selectively directs refrigerant from the main liquid line 52 through the reheat coil 62. This refrigerant is returned to the main circuit through line 64 and check valve 65. This system can be controlled similarly to the FIG. 1 system in maintaining both desired humidity and temperature levels and providing similar benefits. One additional advantage of this system (as well as for the other systems) is that the reheat coil 62 can be reduced in size, since some of the needed subcooling is achieved in the economizer heat exchanger 58.

Figure 2B:
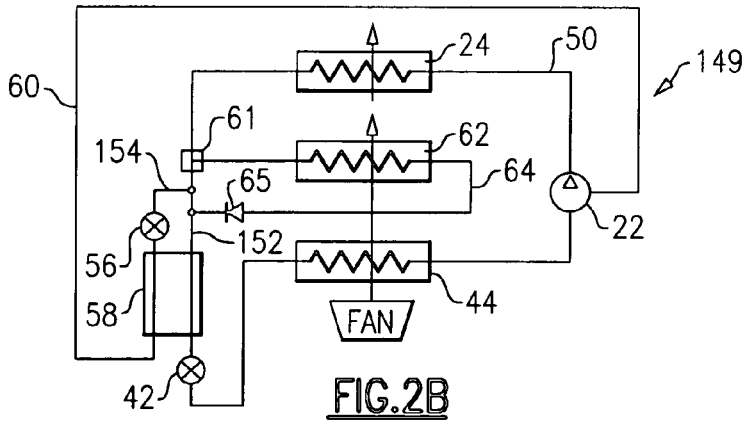
FIG. 2B shows a fifth schematic and FIG. 2C shows a sixth schematic.

FIG. 2B shows another embodiment 149 wherein the tapped fluid 154 line for the economizer heat exchanger 58 is located downstream of the three-way valve 61 but upstream of the junction of the reheat branch return line 64 and main liquid line 152. Otherwise, this system operates in a similar manner to the FIG. 2A system.

Figure 2C:
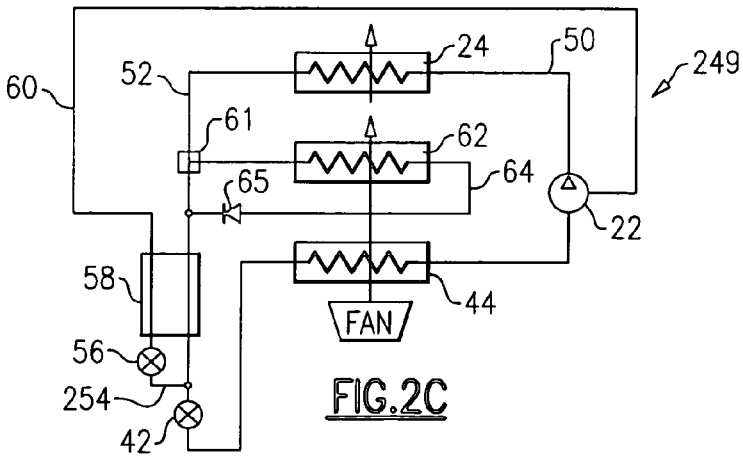

FIG. 2C shows yet another embodiment 249 wherein the tapped fluid line 254 is located downstream of the economizer heat exchanger 58 but still upstream of the main expansion device 42. Otherwise, this system operates in a similar manner to the FIG. 2A system.

Figure 3A:
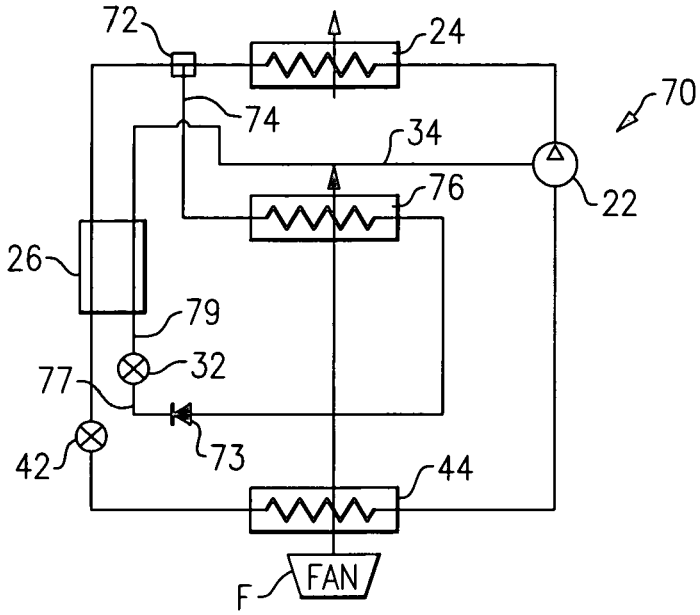
FIG. 3A shows a seventh schematic.

FIG. 3A shows another embodiment 70, wherein the three-way valve 72 is positioned downstream of the condenser 24. In this embodiment, the three-way valve 72 is preferably a regulating device that otherwise can be substituted by a pair of conventional preferably regulating valves. In the FIG. 3A embodiment, the refrigerant passing through line 74 reaches the reheat coil 76 and then rejoins the main refrigerant flow at the junction point 77. As shown, a tap line 79 located downstream from the reheat coil 76 and the check valve 73 passes through the economizer expansion device 32, and through the economizer heat exchanger 26, returning refrigerant through line 34 to the compressor 22. In this embodiment, the main refrigerant flow is preferably split into two parallel flows with one passing through the economizer heat exchanger 26 and another through the reheat coil 76. Again, the basic operation of the system to provide conditioned air is similar to that described above. Obviously, the tap line 79 can also be located downstream of the economizer heat exchanger 26 and upstream of the junction point 77, or downstream of the junction point 77 and upstream of the main expansion device 42.

Figure 3B:
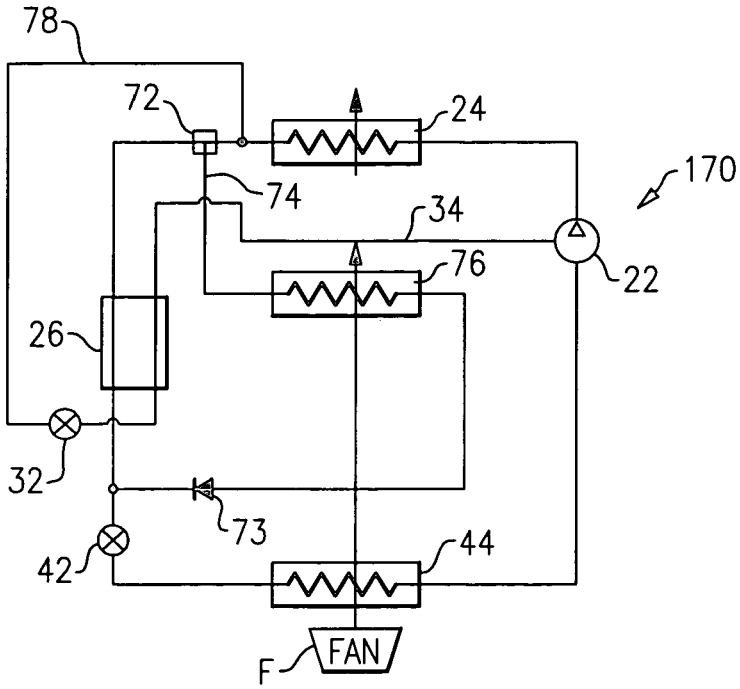
FIG. 3B shows an eighth schematic.

FIG. 3B shows yet another embodiment 170 wherein the tap line 78 to the economizer heat exchanger 26 located upstream of the three-way valve 72. Otherwise, the refrigerant cycle 170 shown in FIG. 3B operates similarly to the earlier embodiments.

Figure 4A:
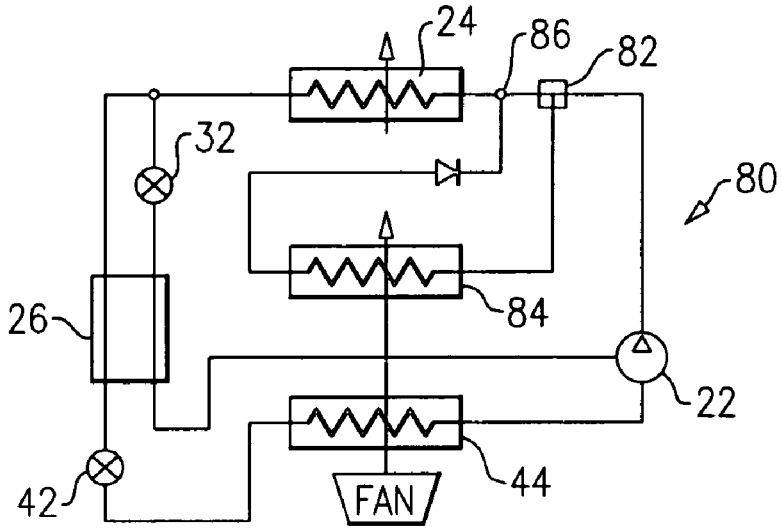
FIG. 4 shows a ninth schematic.

FIG. 4A shows a refrigerant cycle 80 having the three-way valve 82 upstream of the condenser 24. In this embodiment, should the reheat coil 84 be utilized, the refrigerant will be returned to a junction point 86 still upstream of the condenser 24. Again, the system will operate in a similar manner to the previous embodiments to provide air at both desired humidity and temperature levels.

Figure 4B:
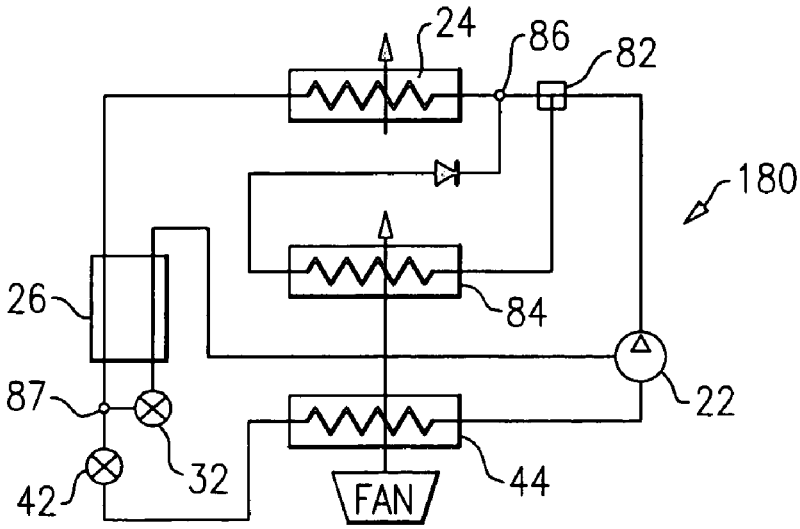

FIG. 4B shows yet another embodiment 180 wherein the tap line 87 is located downstream of the economizer heat exchanger 26 and upstream of the main expansion device 42. Otherwise, the refrigerant cycle 180 shown in FIG. 4B operates similarly to the earlier embodiments.

Figure 5:
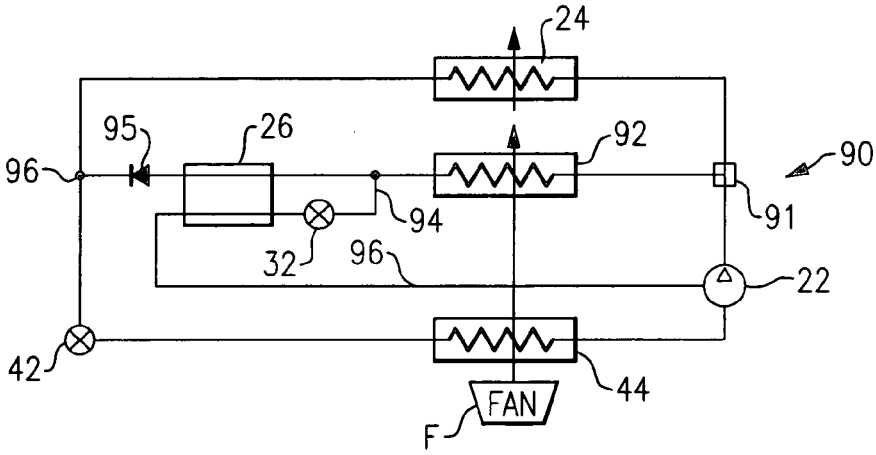
FIG. 5 shows a tenth schematic.

FIG. 5 shows yet another embodiment 90, wherein the three-way valve 91 is positioned upstream of the condenser 24. When the reheat cycle is in operation, refrigerant passes through the reheat coil 92, main refrigerant line 95, the economizer heat exchanger 26, and preferably bypasses the condenser 24, which may be maintained in an inactive mode. If the economizer expansion device 32 is open, a portion of refrigerant is rerouted through the tap line 94, economizer expansion device 32 and economizer heat exchanger 26 to the economizer port of the compressor 22. In this embodiment, the condenser may be bypassed entirely by the flow through the reheat coil 92. Here again, the desired goals mentioned above are achieved. As mentioned before, the tap line 94 may be positioned downstream of the economizer heat exchanger 26 and either downstream or upstream of the check valve 95 and junction point 96.

Figure 6A:
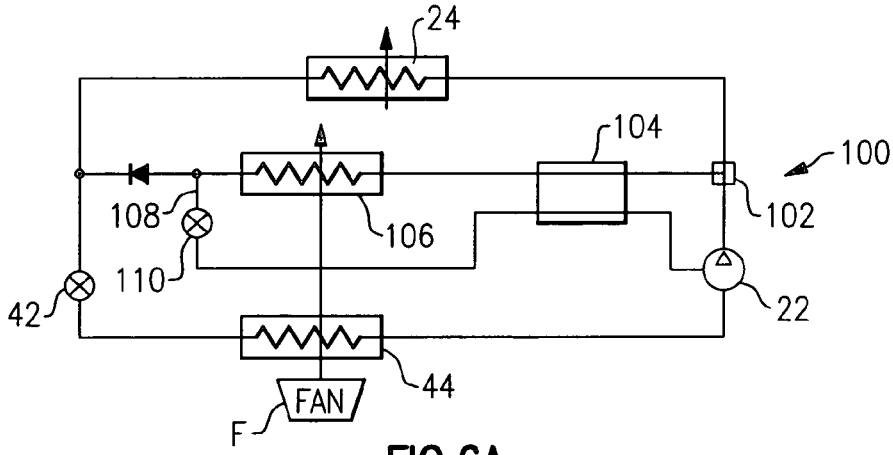
FIG. 6A shows an eleventh schematic.

FIG. 6A shows another embodiment 100, wherein the three-way valve 102 is positioned downstream of the compressor 22. The economizer heat exchanger 104 is located upstream of the reheat coil 106 in this embodiment. Tap 108 is positioned downstream of the reheat coil 106 and passes through the economizer expansion device 110, such that the tapped refrigerant can cool the main flow in the economizer heat exchanger 104. The tapped refrigerant is usually returned as a vapor to the economizer port of compressor 22. Again, the system operation is similar to that shown in FIG. 5, and is described above.

Figure 6B:
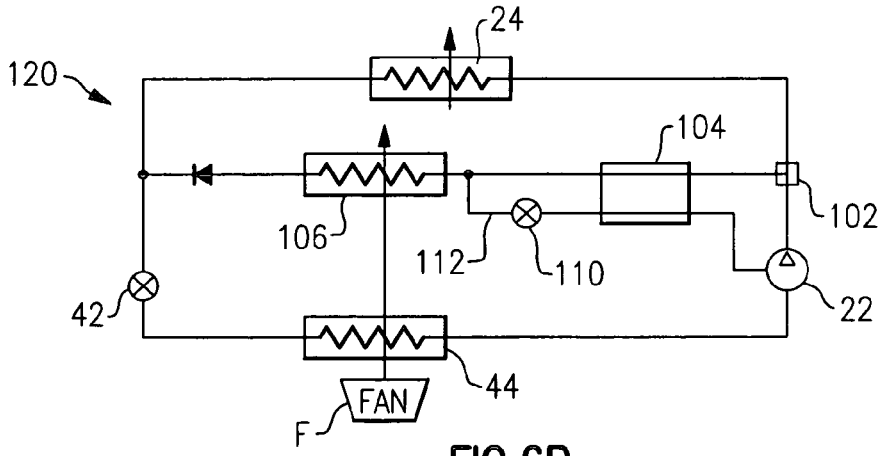
FIG. 6B shows a twelfth schematic.

FIG. 6B shows yet another embodiment 120, which is similar to the FIG. 6A embodiment, however, rather than tapping the refrigerant downstream of the reheat coil 106 for the economizer heat exchanger 104, the refrigerant is tapped from a line 112, upstream of the reheat coil 106.

Figure 7:
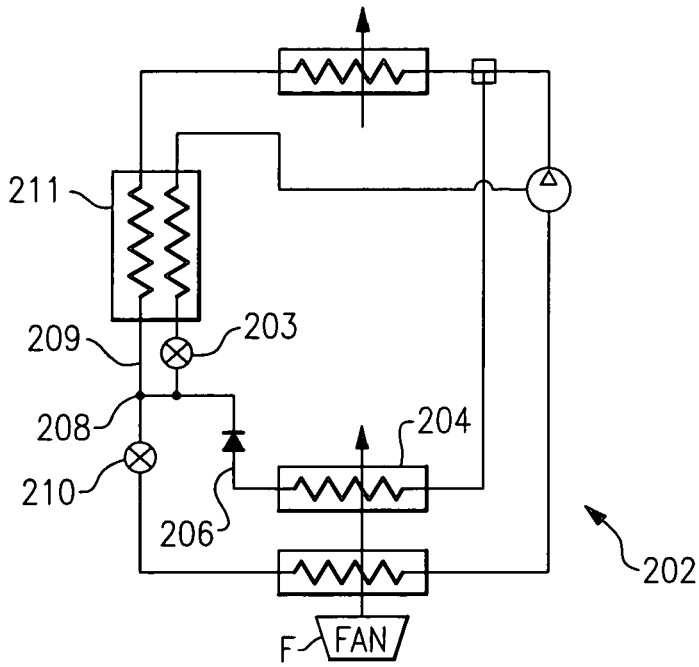
FIG. 7 shows yet another schematic.

FIG. 7 (system 202) shows similar arrangement to FIGS. 6A and 6B with the economizer loop positioned downstream of the condenser coil (rather than downstream of the reheat coil) and the tap line 203 is branched of the reheat circuit line 206 downstream of the reheat coil 204. As it was mentioned before, the tap line can be placed downstream of the junction point 208 of the main circuit and the reheat branch and upstream of the main expansion device 210, or on the line 209 downstream of the economizer heat exchanger 211 and upstream of the junction point 208. For other aspects, see the description of the other embodiments.

Figure 8:
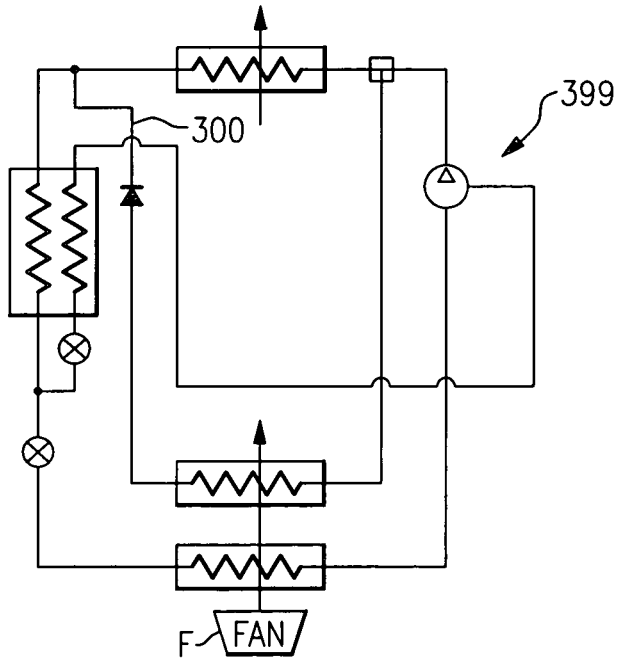
FIG. 8 shows another schematic.

The system 399 shown in FIG. 8 is similar to the system shown in FIG. 7 in terms of operation, and are distinguished by the location of the return line 300 of the reheat circuit to be placed upstream of the economizer heat exchanger connections.

Several embodiments are disclosed, and a worker of ordinary skill in this art would recognize that even other schematics and embodiments would come within the scope of this invention. Generally, the present invention is directed to various combinations of an economizer cycle with a reheat coil. As known, both regulating and conventional flow control devices can be utilized in most cases. Also, the three-way valves can be substituted by a pair of conventional valves. Lastly, identical schematics can be utilized in the multi-circuit system configurations.

The present invention thus provides better control over the air in a conditioned environment with respect to both humidity and temperature levels. In the past, there have been some trade-offs in providing control over both parameters. Additionally, better performance characteristics and more steps of unloading, particularly for the reheat modes of operation are offered. Consequently, more precise temperature and humidity control allows for a lower number of start-stop cycles and improved reliability.

Although preferred embodiments have been disclosed, a worker of ordinary skill in the art would recognize that various modifications would come within the scope of this invention. For that reason, the following claims should be studied to determine the true scope and content of this invention.

What is claimed is:

1. A refrigerant cycle comprising:

a compressor for compressing a refrigerant, and delivering the refrigerant to a condenser, a main expansion device downstream of said condenser, and an evaporator downstream of said main expansion device;

an economizer heat exchanger for receiving a main refrigerant flow, and a tapped refrigerant flow, said tapped refrigerant flow passing through an economizer expansion device, and said tapped refrigerant flow cooling said main refrigerant flow in said economizer heat exchanger;

a reheat coil for receiving at least a portion of a refrigerant flow at a temperature above a temperature of the refrigerant reaching said evaporator, said reheat coil being positioned downstream of said economizer heat exchanger; and an air moving device for driving air over said evaporator and said reheat coil, such that air may be cooled and dehumidified by passing over said evaporator and then be reheated by said reheat coil.

2. The refrigerant cycle as set forth in claim 1, wherein said economizer heat exchanger is positioned downstream of said condenser.

3. The refrigerant cycle as set forth in claim 1, wherein a flow control device is positioned downstream of said economizer heat exchanger and selectively communicates at least a portion of a refrigerant to said reheat coil.

4. The refrigerant cycle as set forth in claim 1, wherein said tapped refrigerant in said economizer heat exchanger is tapped downstream of said condenser and upstream of said economizer heat exchanger.

5. The refrigerant cycle as set forth in claim 1, wherein said tapped refrigerant in said economizer heat exchanger is tapped downstream of said reheat coil and upstream of said main expansion device.

6. The refrigerant cycle as set forth in claim 1, wherein said tapped refrigerant in said economizer heat exchanger is tapped downstream of said economizer heat exchanger and upstream of said reheat coil.

7. A refrigerant cycle comprising:

a compressor for compressing a refrigerant, and delivering the refrigerant to a condenser, a main expansion device downstream of said condenser, and an evaporator downstream of said main expansion device;

an economizer heat exchanger for receiving a main refrigerant flow, and a tapped refrigerant flow, said tapped refrigerant flow passing through an economizer expansion device, and said tapped refrigerant flow cooling said main refrigerant flow in said economizer heat exchanger;

a reheat coil for receiving at least a portion of a refrigerant flow at a temperature above a temperature of the refrigerant reaching said evaporator;

an air moving device for driving air over said evaporator and said reheat coil, such that air may be cooled and dehumidified by passing over said evaporator and then be reheated by said reheat coil; and said reheat coil including a flow control device for communicating refrigerant to said reheat coil, said flow control device being located upstream of said economizer heat exchanger, and said reheat coil returning refrigerant to said main refrigerant flow at a return point, said tapped refrigerant flow being upstream of said return point.

8. The refrigerant cycle as set forth in claim 7, wherein said tapped refrigerant for said economizer heat exchanger is tapped at a location downstream of said condenser, and upstream of said economizer heat exchanger.

9. The refrigerant cycle as set forth in claim 7, wherein said tapped flow for said economizer heat exchanger is tapped from a location upstream of said flow control device.

10. A refrigerant cycle comprising:

a compressor for compressing a refrigerant, and delivering the refrigerant to a condenser, a main expansion device downstream of said condenser, and an evaporator downstream of said main expansion device;

an economizer heat exchanger for receiving a main refrigerant flow, and a tapped refrigerant flow, said tapped refrigerant flow passing through an economizer expansion device, and said tapped refrigerant flow cooling said main refrigerant flow in said economizer heat exchanger;

a reheat coil for receiving at least a portion of a refrigerant flow at a temperature above a temperature of the refrigerant reaching said evaporator, said reheat coil positioned upstream of said condenser; and an air moving device for driving air over said evaporator and said reheat coil, such that air may be cooled and dehumidified by passing over said evaporator and then be reheated by said reheat coil.

11. The refrigerant cycle as set forth in claim 10, wherein said economizer heat exchanger is positioned downstream of said condenser.

12. The refrigerant cycle as set forth in claim 10, wherein refrigerant downstream of said reheat coil is returned to a main flow line upstream of said condenser.

13. The refrigerant cycle as set forth in claim 10, wherein said tapped refrigerant flow is tapped downstream of said economizer heat exchanger.

14. The refrigerant cycle as set forth in claim 10, wherein said tapped refrigerant flow is tapped upstream of said economizer heat exchanger.

15. A refrigerant cycle comprising:

a compressor for compressing a refrigerant, and delivering the refrigerant to a condenser, a main expansion device downstream of said condenser, and an evaporator downstream of said main expansion device;

an economizer heat exchanger for receiving a main refrigerant flow, and a tapped refrigerant flow, said tapped refrigerant flow passing through an economizer expansion device, and said tapped refrigerant flow cooling said main refrigerant flow in said economizer heat exchanger;

a reheat coil for receiving at least a portion of a refrigerant flow at a temperature above a temperature of the refrigerant reaching said evaporator; and an air moving device for driving air over said evaporator and said reheat coil, such that air may be cooled and dehumidified by passing over said evaporator and then be reheated by said reheat coil; and wherein refrigerant is passed through said condenser and/or through serially connected said reheat coil and said economizer heat exchanger.

16. The refrigerant cycle as set forth in claim 15, wherein said refrigerant is serially passed through said economizer heat exchanger, and then through said reheat coil.

17. The refrigerant cycle as set forth in claim 15, wherein said tapped refrigerant for said economizer heat exchanger is tapped downstream of said economizer heat exchanger and upstream of said reheat coil.

18. The refrigerant cycle as set forth in claim 15, wherein said tapped refrigerant for said economizer heat exchanger is tapped downstream of said reheat coil.

19. The refrigerant cycle as set forth in claim 15, wherein said refrigerant is serially passed through said reheat coil, and then through economizer heat exchanger.

20. The refrigerant cycle as set forth in claim 19, wherein said tapped refrigerant for said economizer heat exchanger is tapped downstream of said reheat coil and upstream of said economizer heat exchanger.

21. The refrigerant cycle as set forth in claim 19, wherein said tapped refrigerant for said economizer heat exchanger is tapped downstream of said economizer heat exchanger.

* * * * *